US005469142A

United States Patent [19]

Bergman et al.

[11] Patent Number: 5,469,142

[45] Date of Patent: Nov. 21, 1995

[54] ELECTRONIC ARTICLE SURVEILLANCE SYSTEM HAVING ENHANCED TAG DEACTIVATION CAPACITY

[75] Inventors: Adam S. Bergman; Douglas A. Drew, both of Boca Raton, Fla.

[73] Assignee: Sensormatic Electronics Corporation, Deerfield Beach, Fla.

[21] Appl. No.: 288,087

[22] Filed: Aug. 10, 1994

[51] Int. Cl.[6] ..... G08B 13/24

[52] U.S. Cl. ..... 340/572

[58] Field of Search ..... 340/572, 551

[56] References Cited

U.S. PATENT DOCUMENTS 3,938,044 2/1976 Lichtblau ..... 340/572

4,476,459 10/1984 Cooper et al. ..... 340/572

4,881,061 11/1989 Chambers ..... 340/572

*Primary Examiner*—Glen Swann

*Attorney, Agent, or Firm*—Robin, Blecker, Daley & Driscoll

[57] ABSTRACT

An electronic article surveillance tag deactivation system includes a transmitter, a receiver, a deactivation coil and a controller (microprocessor) for establishing time periods for operation of the transmitter, the receiver and the deactivation coil, and for selectively varying detection sensitivity of the receiver. Detection of a tag prior to deactivation is effected with the receiver at low sensitivity and redetection of the tag subsequent to deactivation is effected with the receiver at high sensitivity.

20 Claims, 5 Drawing Sheets

ELECTRONIC ARTICLE SURVEILLANCE SYSTEM HAVING ENHANCED TAG DEACTIVATION CAPACITY

FIELD OF THE INVENTION

This invention relates generally to electronic article surveillance (EAS) tag deactivation systems and pertains more particularly to improved apparatus and practices for rendering electronic article surveillance tags inactive.

BACKGROUND OF THE INVENTION

It has been customary in the electronic article surveillance (EAS) industry to apply to articles to be monitored disposable adhesive EAS tags or labels functioning as article monitoring devices. At article checkout stations in retail stores, a checkout clerk passes the article over deactivation apparatus which deactivates the monitoring device.

Known deactivation apparatus includes coil structure energizable to generate a magnetic field of magnitude sufficient to render the monitoring device inactive, i.e., no longer responsive to incident energy to itself provide output alarm or to transmit an alarm condition to an alarm unit external to the tag.

One commercial deactivator of the assignee hereof employs one coil disposed horizontally within a housing and tagged articles are moved across the horizontal top surface of the housing such that the tag is disposed generally coplanarly with the coil.

In the normal course of events, the checkout operator deactivates the tag at the checkout station and the customer exits the store with the tagged article.

It is customary in EAS installations to provide a so-called "store exit station" to insure that tagged articles are not removed from a premise in non-deactivated state. Should an article with a tag not deactivated enter the store exit station, an alarm condition is called for.

At times, the deactivation of the checked out article tag is not effective. This results in embarrassment at the store exit station and the possible loss of future shopping in the store by the customer. To avert this situation, the prior art has looked to a "double check station" adjacent the checkout station and remote from the store exit station. The double check station interrogates the article tag, following intended deactivation thereof, and alerts the checkout clerk if indeed the article tag has indeed not been deactivated.

The double check station, while effective in avoiding embarrassment, the operator simply repeating the deactivation cycle and the double check, is manifestly inefficient in requiring additional equipment and space consumption at the checkout station.

The prior art also teaches the use of a single system both to sense the presence of a tag at a deactivation station, to call then for deactivation and then to repeat tag detection, such as is disclosed in U.S. Pat. Nos. 3,938,044 and 4,881,061. However, to the extent that the same detection sensitivity applies to the tag presence sensing and the repeat tag detection, where the tag, following deactivation efforts, is more distal from the detecting antenna, errors can arise, particularly with respect to partially deactivated tags.

SUMMARY OF THE INVENTION

The present invention has as its primary object the provision of improved EAS tag deactivation system and apparatus.

In particular objective, the invention looks to providing EAS tag deactivation system and apparatus overcoming the disadvantages of the prior art above noted.

In attaining these and other objects, the invention provides, in an EAS tag deactivation system, a transmitter, a receiver, a deactivation coil and a controller (microprocessor) for establishing time periods for operation of the transmitter, the receiver and the deactivation coil, and for selectively varying detection sensitivity of the receiver.

In another aspect, the invention provides a receiver for an electronic article surveillance tag deactivation system controllable to exhibit variable tag detection sensitivity.

The invention also features methods for use in EAS tag deactivation, discussed hereinafter.

The foregoing and other objects and features of the invention will be further understood from the following detailed description of preferred embodiments thereof and from the drawings, wherein like reference numerals identify like components throughout.

DETAILED DESCRIPTION OF PREFERRED EMBODIMENTS AND PRACTICES

Figure 1:
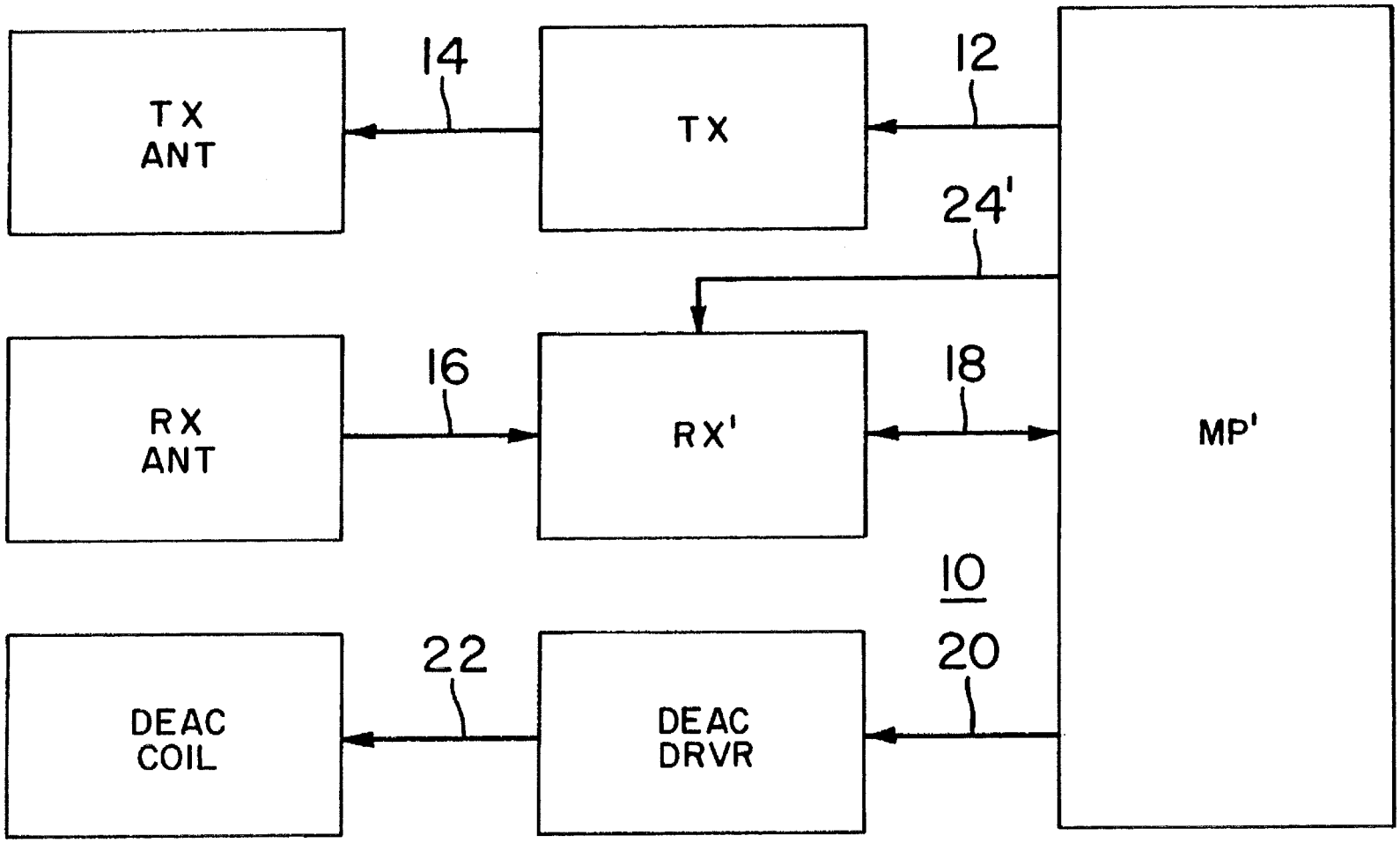
FIG. 1 is a general block diagram of an EAS tag deactivation system in accordance with the invention.

With the exception of components noted with a prime (′), EAS tag deactivation system 10 of FIG. 1 is quite well known in the prior art. Microprocessor MP′ is typically programmed to provide a signal on line 12 to energize transmitter TX, which furnishes excitation over line 14 to transmitting antenna TXANT. Receiving antenna RXANT furnishes received signals over line 16 to receiver RX′, which communicates with microprocessor MP′ over lines 18. Line 20 furnishes microprocessor control signals for tag deactivator driver DEAC DRVR, which in turn furnishes excitation over line 22 to deactivation coil DEAC COIL.

The known EAS tag deactivation system is changed in accordance with the subject invention by modifying receiver RX′ to have variable sensitivity, by modifying microprocessor MP′ to have facility for controlling the receiver sensitivity and by providing line 24′ to convey sensitivity control information from the microprocessor to the receiver.

Figure 2:
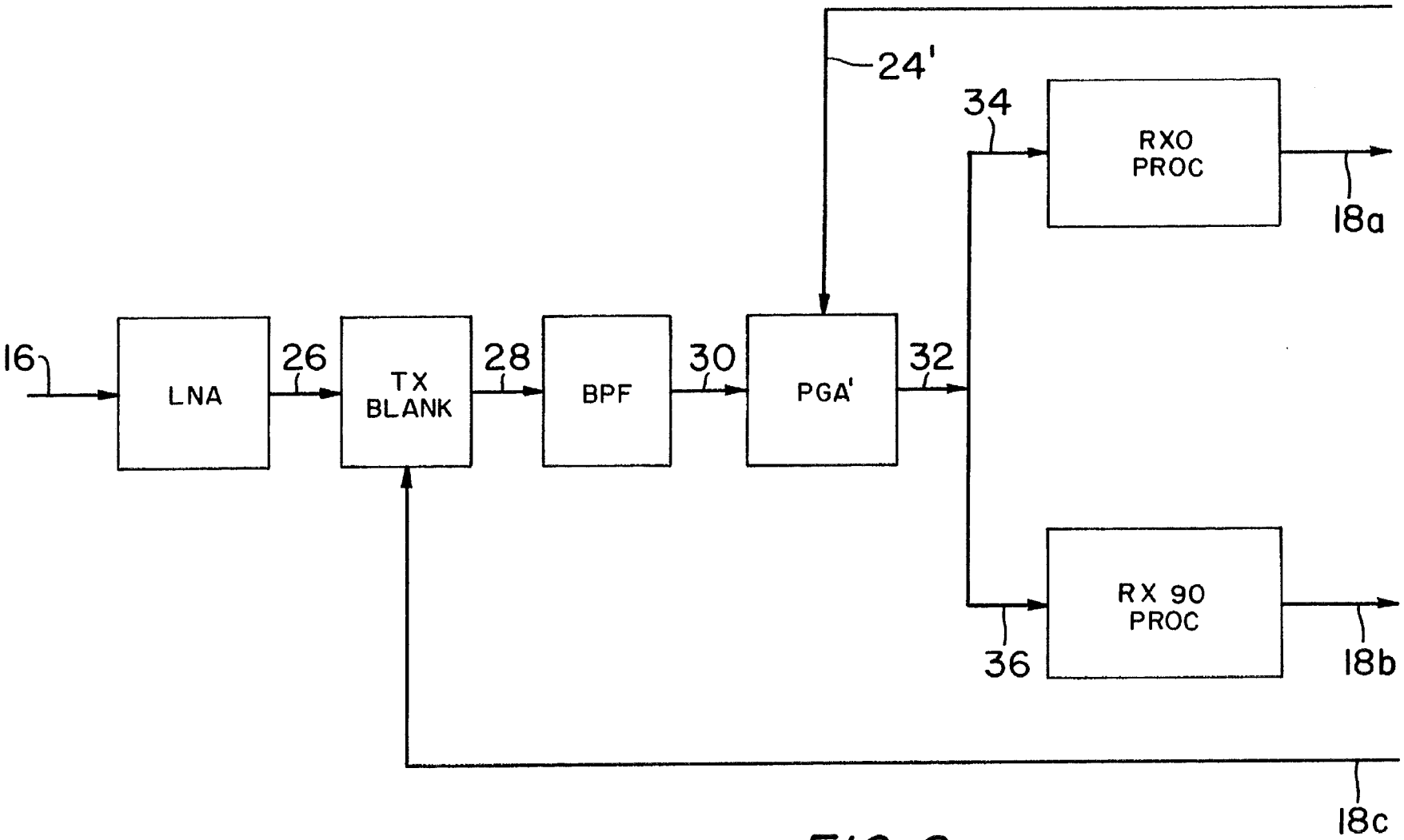
FIG. 2 is a partial block diagram of the receiver of the FIG. 1. EAS tag deactivation system.

The modified receiver RX′ is shown in FIG. 2. Received signals on antenna output line 16 are amplified in low noise amplifier LNA and applied to transmitting blank TX BLANK unit, which mutes the receiver during transmitting periods per microprocessor control over line 18*c*. During non-transmitting periods, line 28 provides signals to bandpass filter BPF, whose output signals are furnished to line 30.

The receiver RX′ of the invention at this juncture introduces programmable gain amplifier PGA′, the gain of which is controlled by the microprocessor by signals on the aforementioned line 24′. Amplified signals are conveyed over lines 32 and 34 to receiver zero degree phase processing circuitry RX0 PROC, and over lines 32 and 36 to receiver ninety degree phase processing circuitry RX90 PROC, and receiver in-phase and quadrature output signals are provided to the microprocessor over lines 18*a* and 18*b*, respectively.

Figure 3:
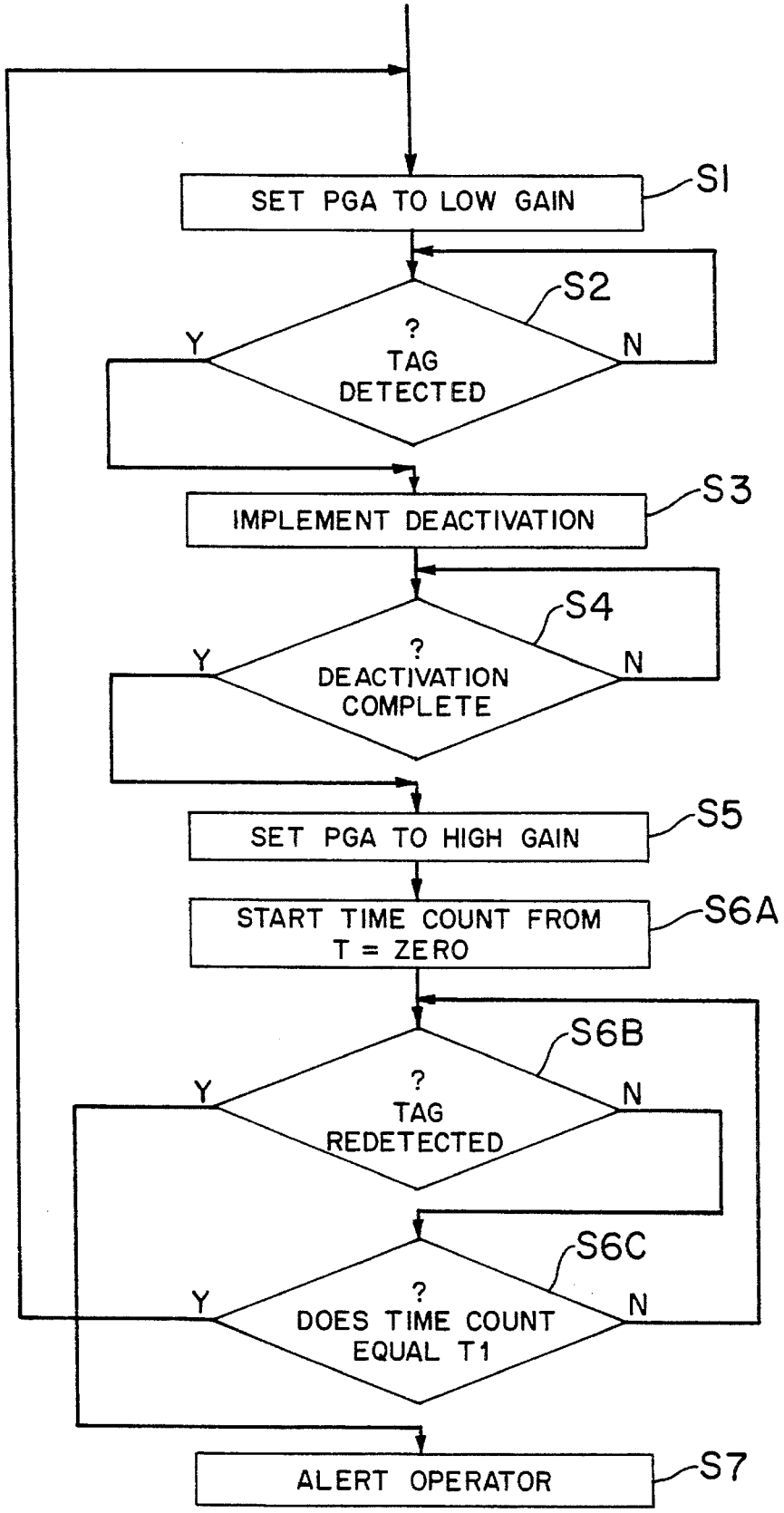
FIG. 3 is a flow chart of a first deactivation practice in accordance with the invention as implemented by the microprocessor of the FIG. 1 EAS tag deactivation system.

A first practice in accordance with the invention will be understood by reference to the flow chart of FIG. 3. In step S1, SET PGA TO LOW GAIN, the microprocessor sets the programmable gain amplifier to a low gain whereby the receiver has low sensitivity. In step S2, ? TAG DETECTED, the microprocessor examines receiver output signals on lines 18*a* and 18*b* to determine whether a tag is present at the checkout station. Upon negative (N) answers to the step S2 inquiry, the step is repeated. Upon an affirmative (Y) answer, progress is to step S3, IMPLEMENT DEACTIVATION, and the microprocessor initiates tag deactivation by signal provided on line 20 of FIG. 1.

Upon affirmative answer to the step S4 inquiry, ? DEACTIVATION COMPLETE, progress is to step S5, SET PGA TO HIGH GAIN, wherein the microprocessor sets the programmable gain amplifier to a high gain whereby the receiver has high sensitivity.

Tag deactivation at checkout is a continuous process, involving tag after tag. For example, at a bookstore, a customer may be purchasing several books and the checkout clerk may pass the series of books over the deactivator within seconds of each other. Accordingly, a time period for checking individual tags for deactivation is established, preferably some three hundred and fifty milliseconds.

In step S6A, START TIME COUNT FROM T=ZERO, the time period is started. In step S6B, ? TAG REDETECTED, inquiry is made as to whether a tag intended to be deactivated is not deactivated.

With the receiver now at high sensitivity, double checking is effected with correspondingly enhanced ability, so as to detect not only tags which have not been deactivated, but also to detect partially deactivated tags. Further, the "volume" of the detection capability is extended, i.e., the tag can be further from the receiving antenna than would otherwise be the case.

Upon affirmative answer to the step S6B inquiry, progress is to step S7, ALERT OPERATOR, wherein a warning tone or the like is provided to call for repeat of the deactivation cycle of FIG. 3.

Upon negative answer to the step 6A inquiry, progress is to step S6C, ? DOES TIME COUNT EQUAL T1. If the time period has not expired, step S6B is repeated. When the time period has expired, progress is to step S1 and deactivation of the next tag in the series. In effect, steps S6A–S6C establish a time period for practice of the step S7 of providing an alert indication upon the receiver detection of a when set at the second tag detection sensitivity.

Figure 4A:
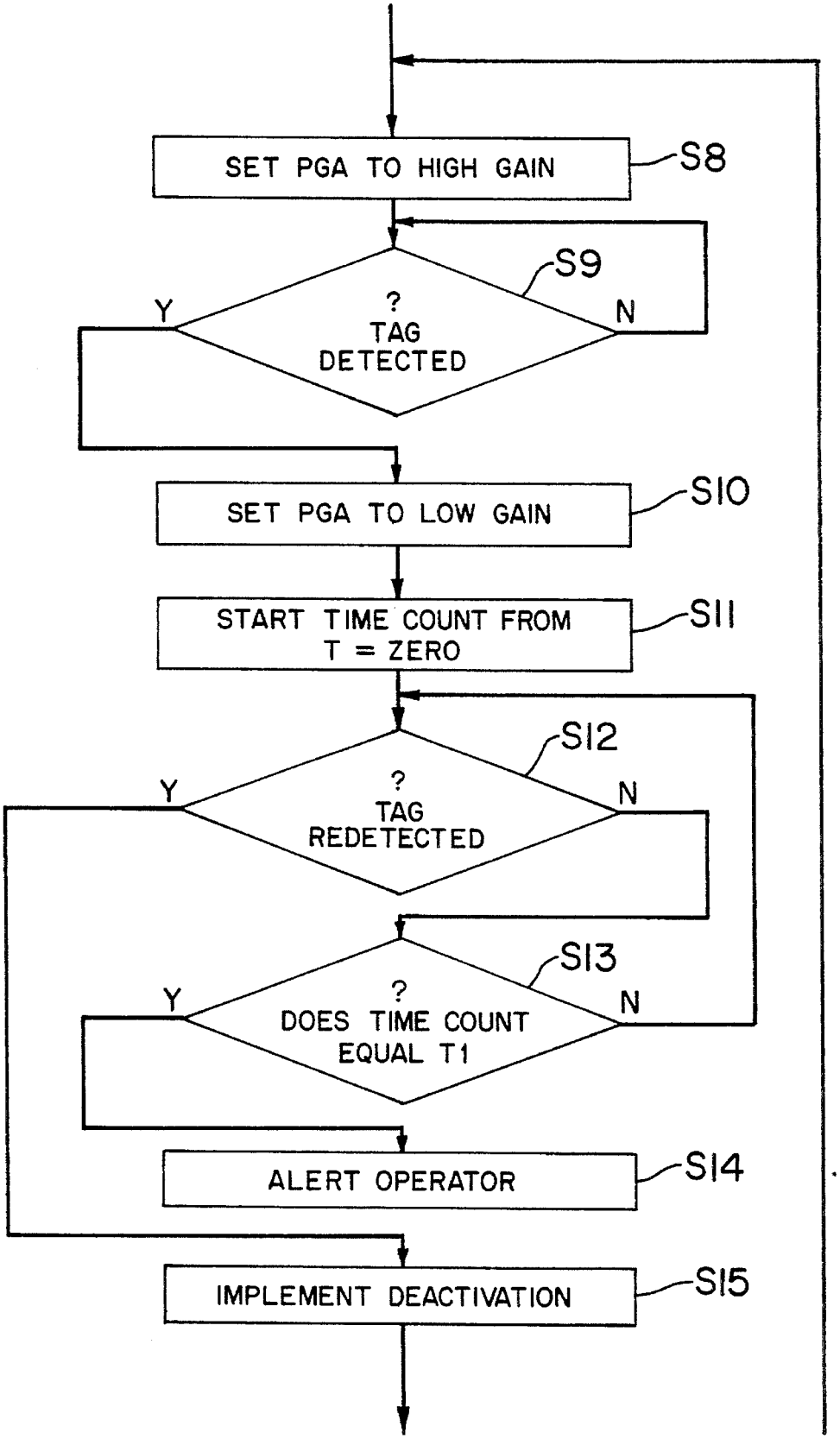
FIGS. 4*a* and 4*b* present a flow chart of a second deactivation practice in accordance with the invention as implemented by the microprocessor of the FIG. 1 EAS tag deactivation system.
Figure 4B:
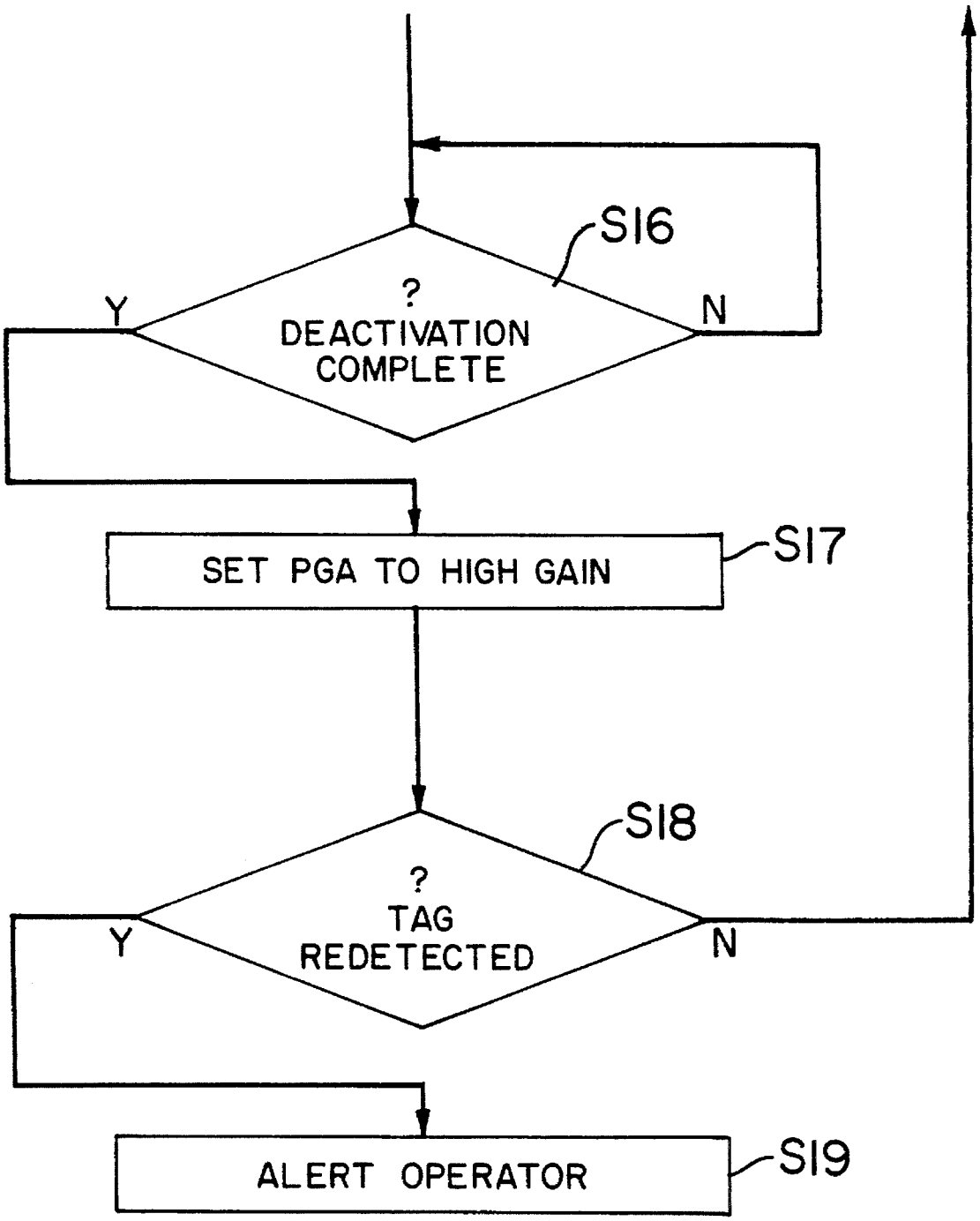

A second practice in accordance with the invention will be understood by reference to the flow chart of FIGS. 4*a* and 4*b*. In step S8, SET PGA TO HIGH GAIN, the microprocessor sets the programmable gain amplifier to a high gain whereby the receiver has high sensitivity. In step S9, ? TAG DETECTED, the microprocessor examines receiver output signals on lines 18*a* and 18*b* to determine whether a tag is present at the checkout station. Upon negative (N) answers to the step S9 inquiry, the step is repeated. Upon an affirmative (Y) answer, progress is to step S10, SET PGA TO LOW GAIN, wherein the microprocessor sets the programmable gain amplifier to a low gain whereby the receiver has low sensitivity.

In step S11, START TIME COUNT FROM T=ZERO, the microprocessor commences measurement of the passage of time. Step S12, ? TAG REDETECTED, is then practiced.

Upon negative answer to the step S12 inquiry, progress is to step S13, ? DOES TIME COUNT EQUAL T1, wherein the microprocessor determines whether a preset time period, zero to T1, has expired without redetection of the tag. If the preset time period has not expired, progress is back to step S12. If the preset time period has expired without tag redetection, progress is to step S14, ALERT OPERATOR, where a warning tone or the like is provided to call for repeat of the deactivation cycle of FIGS. 4*a* and 4*b*.

Upon affirmative inquiry to the step S12 inquiry, progress is to step S15, IMPLEMENT DEACTIVATION, and the microprocessor initiates tag deactivation by signal provided on line 20 of FIG. 1. Upon affirmative answer to the step S16 inquiry, ? DEACTIVATION COMPLETE, progress is to step S17, SET PGA TO HIGH GAIN, wherein the microprocessor sets the programmable gain amplifier to a high gain whereby the receiver has high sensitivity. Step S18, ? TAG REDETECTED, is then practiced.

As in the case of the FIG. 3 practice, with the receiver now at high sensitivity, double checking is effected with correspondingly enhanced ability, so as to detect not only tags which have not been deactivated, but also to detect partially deactivated tags. Further, the "volume" of the detection capability is likewise extended, i.e., the tag can be further from the receiving antenna than would otherwise be the case.

Upon affirmative answer to the step S18 inquiry, progress is to step S19, ALERT OPERATOR, wherein a warning tone or the like is provided to call for repeat of the deactivation cycle of FIGS. 4*a* and 4*b*. Upon negative answer to the step S19 inquiry, progress is to step S8 and deactivation of the next tag presented to the system.

As will be appreciated, the second practice may evidently include, in lieu of step S18, steps S6A–S6C of FIG. 3, wherein a time period for practice of tag redetection is set.

By way of summary and in introduction of the ensuing claims, the invention will be seen in its system aspect to comprise a transmitter, a receiver, a deactivation coil and a controller (microprocessor) for establishing time periods for operation of the transmitter, the receiver and the deactivation coil, and for selectively varying detection sensitivity of the receiver. In particular, the controller sets a time period for operation of the transmitter, a successive first time period for operation of the receiver, a successive second time period upon receiver detection of a tag for operation of the deactivation coil, a successive third time period for operation of the transmitter and a successive fourth time period for operation of the receiver. The controller changes the receiver detection sensitivity from a first sensitivity in the successive first time period to a second sensitivity in the successive fourth time period. The second sensitivity is higher than the first sensitivity.

The receiver comprises a variable gain amplifier and the controller controls the gain of the variable gain amplifier.

In another aspect, the invention provides a receiver for an electronic article surveillance tag deactivation system controllable to exhibit variable tag detection sensitivity.

In one method aspect, the invention involves steps of establishing a tag detection field, providing a receiver having at least first and second different tag detection sensitivities, setting the receiver to the first tag detection sensitivity and, upon detection of a tag by the receiver, applying a tag deactivating field to the tag, reestablishing the tag detection field, and setting the receiver to the second tag detection sensitivity. A further step is that of providing an alert indication upon the receiver detecting the tag when set at the second tag detection sensitivity. The steps establishing and reestablishing the field are practiced by using the same transmitter. To accommodate rapid response to redetection of a series of tags, a time period for practice of tag redetection is set In another method aspect, the invention involves steps of establishing a tag detection field, providing a receiver having at least first and second different tag detection sensitivities, setting the receiver to the second tag detection sensitivity and, upon detection of a tag by the receiver, setting the receiver to the first tag detection sensitivity, and upon redetection of the tag by the receiver when set to the first tag detection sensitivity, applying a tag deactivating field to the tag. Further steps are establishing a time period upon setting the receiver to the first detection sensitivity for the tag redetection and providing an alert indication upon the receiver not redetecting the tag during the time period.

Still further steps, following deactivation, are resetting the receiver to the second detection sensitivity and reestablishing the tag detection field. A final step is that of providing an alert indication upon the receiver detecting the tag when reset to the second tag detection sensitivity. Again, the steps establishing and reestablishing the field are practiced by using the same transmitter.

Various changes to the particularly disclosed embodiments and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. An electronic article surveillance tag deactivation system, comprising:

(a) a transmitter;

(b) a receiver;

(c) a deactivation coil; and (d) control means for establishing time periods for operation of said transmitter, said receiver and said deactivation coil, and for selectively varying detection sensitivity of said receiver.

2. The system claimed in claim 1, wherein said control means sets a time period for operation of said transmitter, a successive first time period for operation of said receiver, a successive second time period upon the receiver's detection of a tag for operation of said deactivation coil, a successive third time period for operation of said transmitter and a successive fourth time period for operation of said receiver, said control means changing the receiver detection sensitivity from a first sensitivity in said successive first time period to a second sensitivity in said successive fourth time period.

3. The system claimed in claim 2, wherein said second sensitivity is higher than said first sensitivity.

4. The system claimed in claim 1, wherein said receiver comprises a variable gain amplifier and wherein said control means controls the gain of said variable gain amplifier.

5. The system claimed in claim 4, wherein said variable gain amplifier is a programmable gain amplifier.

6. A receiver for an electronic article surveillance tag deactivation system, said receiver receiving signals from tags and controllable to exhibit variable tag detection sensitivity independently of amplitudes of the received tag signals.

7. The receiver claimed in claim 6, comprising a variable gain amplifier controllable to provide said receiver variable tag detection sensitivity.

8. The receiver claimed in claim 7, wherein said variable gain amplifier is a programmable gain amplifier.

9. A method for deactivating electronic article surveillance tags, comprising the steps of:

(a) establishing a tag detection field;

(b) providing a receiver having at least first and second different tag detection sensitivities;

(c) setting said receiver to said first tag detection sensitivity and, upon detection of a tag by said receiver, applying a tag deactivating field to said tag;

(d) reestablishing said tag detection field; and (e) setting said receiver to said second tag detection sensitivity.

10. The method claimed in claim 9, including the further step of providing an alert indication upon the receiver's detection of said tag when set at said second tag detection sensitivity.

11. The method claimed in claim 10, including the further step of establishing a time period for practice of said step of providing an alert indication upon said receiver detection of said tag when set at said second tag detection sensitivity.

12. The method claimed in claim 9 wherein said second tag detection sensitivity is selected to be higher than said first detection sensitivity.

13. The method claimed in claim 9 wherein said steps (a) and (d) are practiced by using the same transmitter.

14. A method for deactivating electronic article surveillance tags, comprising the steps of:

(a) establishing a tag detection field;

(b) providing a receiver having at least first and second different tag detection sensitivities;

(c) setting said receiver to said second tag detection sensitivity and, upon detection of a tag by said receiver, setting said receiver to said first tag detection sensitivity; and (d) upon redetection of said tag by said receiver when set to said first tag detection sensitivity, applying a tag deactivating field to said tag.

15. The method claimed in claim 14, including the further steps of establishing a time period upon setting said receiver to said first detection sensitivity for said tag redetection and providing an alert indication upon the receiver's not redetecting said tag during said time period.

16. The method claimed in claim 14, including the further steps, practiced after completion of said step (d), of resetting said receiver to said second detection sensitivity and reestablishing said tag detection field.

17. The method claimed in claim 16, including the further step of providing an alert indication upon the receiver's detection of said tag when reset to said second tag detection sensitivity.

18. The method claimed in claim 17, including the further step of establishing a time period for practice of said step of providing an alert indication upon said receiver detection of said tag when set at said second tag detection sensitivity.

19. The method claimed in claim 16 wherein said steps of establishing and reestablishing said tag detection fields are practiced by using the same transmitter.

20. The method claimed in claim 14, wherein said second tag detection sensitivity is selected to be higher than said first detection sensitivity.

* * * * *